United States Patent [19]

Premel

[11] Patent Number: 4,803,957

[45] Date of Patent: Feb. 14, 1989

[54] GAS/LIQUID HEAT EXCHANGER

[75] Inventor: Ulrich Premel, Gummersbach, Fed. Rep. of Germany

[73] Assignee: L. & C. Steinmüller GmbH, Gummersbach, Fed. Rep. of Germany

[21] Appl. No.: 169,299

[22] Filed: Mar. 17, 1988

[30] Foreign Application Priority Data

Mar. 21, 1987 [DE] Fed. Rep. of Germany ..... 3709339

[51] Int. Cl.[4] ..... F22D 1/00

[52] U.S. Cl. ..... 122/7 R; 122/32; 165/163

[58] Field of Search ..... 122/32, 7 R; 165/162, 165/163

[56] References Cited

U.S. PATENT DOCUMENTS 4,462,339 7/1984 Jahnke et al. ..... 122/32 X
4,488,513 12/1984 Jahnke et al. ..... 122/7 R X
4,564,067 1/1986 Premel ..... 165/163

*Primary Examiner*—Edward G. Favors
*Attorney, Agent, or Firm*—Becker & Becker, Inc.

[57] ABSTRACT

A gas/liquid heat exchanger. Process gases leaving the heat-transfer elements of a heat-transfer-surface unit are guided through the displacement body that is associated with that unit. Feed water is introduced into the displacement body at the lower end thereof. After countercurrent heat-exchange flow relative to the process gas, the feed water is withdrawn from the upper end of the displacement body, and is introduced into a zone of downwardly flowing water.

12 Claims, 3 Drawing Sheets

GAS/LIQUID HEAT EXCHANGER

BACKGROUND OF THE INVENTION

The present invention relates to a gas/liquid heat exchanger having an upright pressure tank that includes a water chamber, at least one heat-transfer-surface unit, which is disposed in the water chamber and extends along the tank, a saturated steam chamber disposed above the water chamber, and built-in components that divide the water chamber into regions or zones of: water that flows upwardly along the heat-transfer-surface unit, water that flows downwardly, and calm water; each heat-transfer-surface unit includes a displacement body and heat-transfer-surface elements, especially helical heat-transfer-surface elements, that are disposed about the displacement body and have hot process gas under pressure flowing through them.

A heat exchanger of this general type is disclosed in U.S. Pat. No. 4,538,676, which belongs to the assignee of the present application. With this known heat exchanger, the exit temperature of the process gas as it leaves the pressure tank is always about 30°–40° C. greater than the saturated steam temperature. It is not possible to cool the process gas any further, because the temperature difference between the temperature of the steam/water mixture and the exit temperature of the process gas is already very small, and the efficiency of the heat-transfer surfaces is correspondingly low. After leaving the heat exchanger, the process gas is customarily rid of particulates in a wet scrubber, so that the heat content of the process gas supplied to the wet scrubber can no longer be relied upon for energy exploitation.

It is therefore an object of the present invention to provide a gas liquid heat exchanger of the aforementioned general type with which it is possible to make greater utilization of the heat from the process gas; in other words, a heat exchanger that has an improved efficiency.

A further object of the present invention is to reduce the size of the heat-transfer surfaces of the heat exchanger while maintaining the exit temperature of the process gases therefrom.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

The heat exchanger of the present invention is characterized primarily in that the process gases leaving the heat-transfer-surface elements are guided through the displacement body, feed water is introduced into the displacement body at the lower end thereof, the feed water is conveyed through the displacement body in countercurrent heat exchange flow relative to the process gas, the feed water is withdrawn from the displacement body at the upper end thereof, and the feed water is introduced into a zone of downwardly flowing circulating water.

Thus, with the heat exchanger of the present invention, the displacement body assumes a dual function. On the one hand, the displacement body assures that the upwardly flowing water will be guided along the elements of the heat-transfer-surface unit. On the other hand, the displacement body is used to guide the cold feed water that is introduced into the tank, for example at 100° C. below the saturated steam temperature, in countercurrent flow relative to the process gas that leaves the heat-transfer-surface unit. The greater temperature difference relative to the feed water and the process gas thus even makes it possible to cool the process gas to below the saturated steam temperature. This further cooling of the process gas improves the utilization of the heat of the latter.

Even if the reduction of the gas exit temperature is not the chief aim of the present invention, nonetheless the inventive configuration of the heat exchanger offers the advantage that if the gas exit temperature is maintained, the overall size or surface area of the heat-transfer-surface elements can be reduced in conformity to the greater $\Delta t$ relative to the feed water and the process gas.

Two possibilities are provided for achieving the countercurrent flow of the feed water relative to the exiting process gas:

The displacement body can be filled with feed water, and the process gas is guided in a line that passes through the displacement body, or the displacement body is filled process gas, and the feed water is guided in a line that passes through the displacement body.

The line that passes through the displacement body can have various shapes. For example, it can be straight cylindrical and/or widened or enlarged and/or helical.

When the displacement body is filled with water, it is advantageous to provide flow-guide fins between the inner wall of the displacement body and a cylindrical line, with these fins imparting a helical flow of the feed water about the line.

In order to facilitate introduction of the water that exits the displacement body into the zone of downward flow, it is advantageous to provide a downwardly directed gravity or down pipe at the exit of the feed water from the displacement body.

Further specific features of the present invention will be described in detail subsequently.

DESCRIPTION OF PREFERRED EMBODIMENTS

Figure 1:
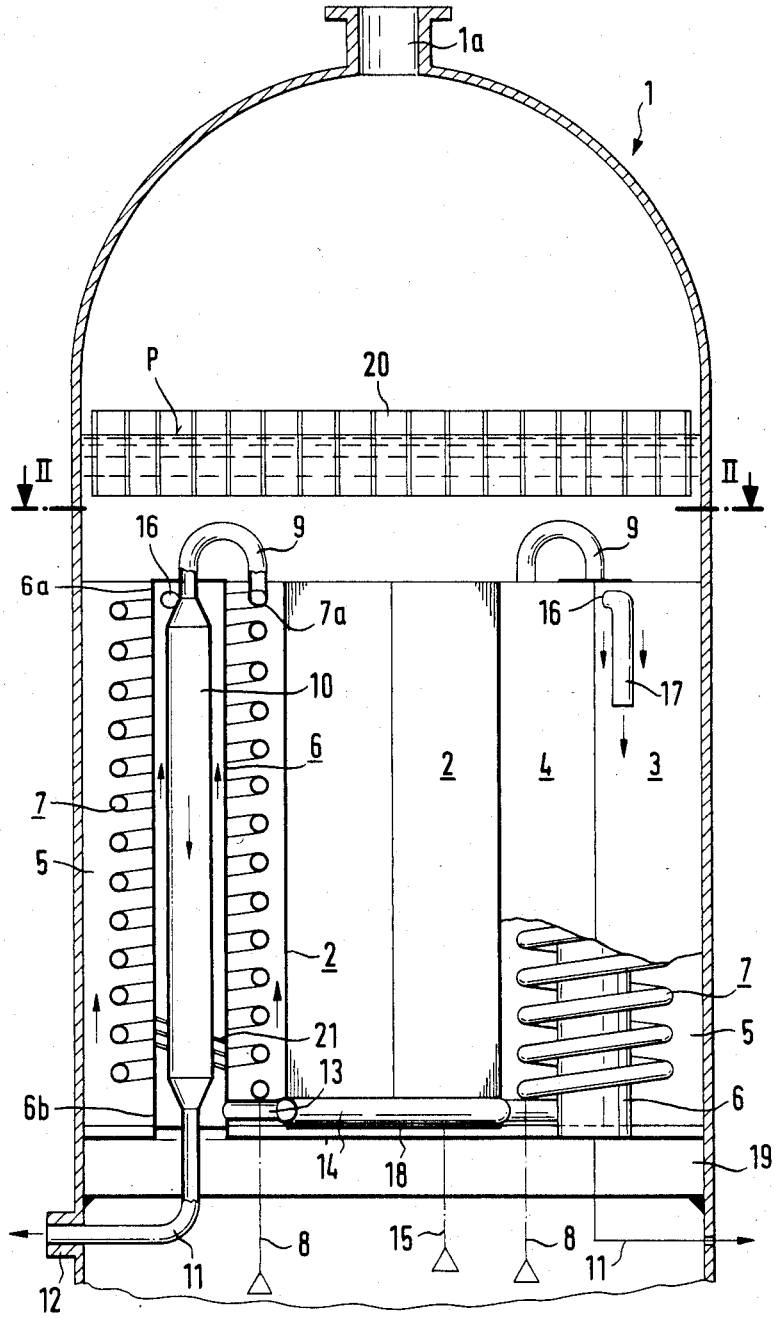
FIG. 1 is a partial sectioned view through one exemplary embodiment of the inventive gas/liquid heat exchanger, taken along the line I—I in FIG. 2.
Figure 2:
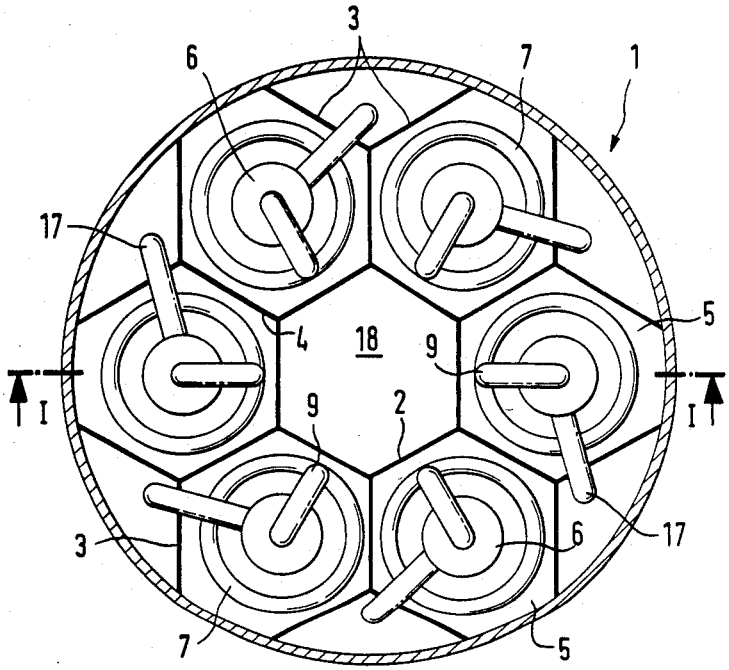
FIG. 2 is a cross-sectional view through the heat exchanger of FIG. 1 along the line II—II thereof.

Referring now to the drawings in detail, as can be seen from FIGS. 1 and 2, disposed centrally and coaxially within a tank 1 is a hexagonal displacement body 2. Provided opposite the corners of this displacement body 2 are wall units 3 that are connected to the tank 1. If necessary, the corners of the displacement body 2 can be connected to the wall units 3 via planar wall units 4.

Disposed in the compartments or cells 5 that surround the displacement body 2, along an imaginary circle, are cylindrical displacement bodies 6 about which are disposed, in turn, coaxial heat-transfer-surface elements 7 that extend in a helical manner. Supplied to the heat-transfer-surface elements 7, via feed lines 8, is hot process gas that is under pressure.

The upper end *7a* of the heat-transfer-surface element 7 is connected via a connecting line 9 to a widened or enlarged conduit 10 that extends downwardly through the interior of the displacement body 6 from above. The lower end of the conduit 10 is connected via a connecting line 11 to a gas outlet 12 via which the process gas is withdrawn from the tank 1.

The lower end *6b* of the displacement body 6 is connected to a supply line 13 to which cold feed water is supplied via a ring conduit 14 and a water-supply line 15.

The upper end *6a* of the displacement body 6 is connected to a water outlet 16 to which is connected a downwardly extending gravity or down pipe 17 that extends into the wedge-shaped free space between the wall units 3 and the inner wall of the tank 1.

The bottom end of the displacement body 2 is closed off by a plate 18, and the various heat-transfer-surface units are supported on a support structure 19 that is indicated only schematically and that in turn is connected to the inner wall of the tank 1.

The tank 1, which is provided with a steam outlet 1a, is filled with water to the indicated level P. Disposed in the undulating region of the water level P is a calming device 20 for calming the surface of the water.

During operation of the heat exchanger, a zone without liquid flow develops within the displacement body 2, while about the heat-transfer-surface units 7 a zone of upwardly directed flow develops, and in the wedges between the wall units 3 and the inner wall of the tank, zones of downwardly directed liquid flow develop.

The feed water supplied by the line 15 is heated in a countercurrent flow by the process gas that is flowing downwardly in the conduit 10. The preheated feed water is introduced via the down pipes 17 into the downwardly directed liquid flow of the circulating water. In other words, as a result of the pump pressure that occurs in the line 15, a flow of the feed water is induced through the displacement bodies, and the preheated feed water that leaves the displacement bodies is introduced into the natural circulation in the tank.

In order to be able to impart a helical course to the upwardly directed water flow within the displacement bodies 6, it is possible to provide appropriate guide elements 21, such as fins, at least in the lower portion of the annular gap that is provided between the conduit 10 and the displacement body.

Figure 3:
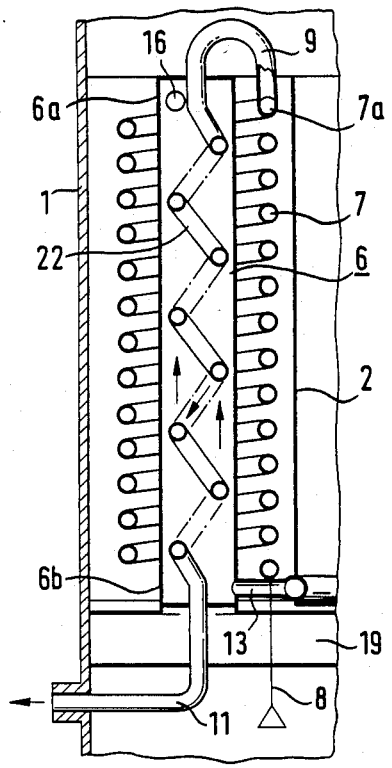
FIG. 3 is a partial sectioned view through a second exemplary embodiment of the inventive gas/liquid heat exchanger.

The embodiment illustrated in FIG. 3 differs from the embodiment of FIGS. 1 and 2 in that instead of having an enlarged conduit 10, this embodiment is provided with a helical conduit 22 within the displacement body 6.

Figure 4:
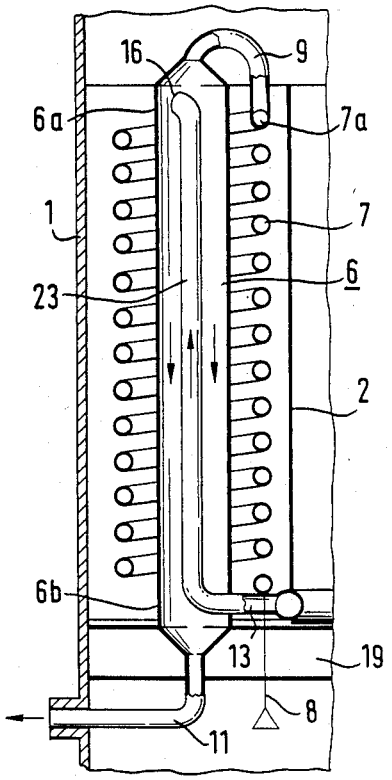
FIG. 4 is a partial sectioned view through a third exemplary embodiment of the inventive gas/liquid heat exchanger.

The embodiment illustrated in FIG. 4 differs from the previous embodiments in that the displacement body 6 is supplied with the process gas rather than with feed water, while the feed water is guided within a line 23 that passes through the displacement body 6 from the bottom toward the top.

With all of the inventive embodiments, the basic construction of the type of heat exchanger disclosed in the aforementioned U.S. Pat. No. 4,538,676 can be maintained, with an increased utilization of heat, and/or a reduction in size of the individual heat-transfer-surface units and hence of the overall heat exchanger, being possible due to the feed water preheater that is integrated into the displacement body.

The present inventive concept could also be used in conjunction with a heat exchanger of the type disclosed in applicant's German patent application P No. 36 02 935, filed Jan. 31, 1986, where a superheater is disposed downstream of the saturated-steam chamber above the calming device.

The present invention is currently viewed as having primary application as a waste-heat tank following a pressure gasification, especially a partial oxidation.

The present invention is, of course, in no way restricted to the specific disclosure of the specification and drawings, but also encompasses any modifications within the scope of the appended claims.

What I claim is:

1. In a gas/liquid heat exchanger having an upright pressure tank that includes a water chamber, at least one heat-transfer-surface unit, which is disposed in said water chamber and extends along said pressure tank, a saturated steam chamber disposed above said water chamber, and built-in components that divide said water chamber into zones of: water that flows upwardly along said heat-transfer-surface unit, water that flows downwardly, and calm water, with each heat-transfer-surface unit including a displacement body and heat-transfer-surface elements, especially helical heat-transfer-surface elements, that are disposed about said displacement body and have hot process gas under pressure flowing through them, the improvement comprising:

means for conveying process gas from said heat-transfer-surface elements through said displacement body; and means for introducing feed water into said displacement body at a bottom end region thereof, conveying said feed water through said displacement body in countercurrent heat-exchange flow relative to said process gas, withdrawing said feed water from said displacement body at an upper end region thereof, and introducing said feed water into a zone of downwardly flowing water.

2. A gas/liquid heat exchanger according to claim 1, in which said means for conveying process gas is a line that communicates with said heat-transfer-surface elements and extends through said displacement body; and in which said means for conveying said feed water through said displacement body is said displacement body itself.

3. A gas/liquid heat exchanger according to claim 2, in which said line that extends through said displacement body is straight cylindrical and/or enlarged and/or helical.

4. A gas/liquid heat exchanger according to claim 2, in which said displacement body has an inner wall, and said line that extends through said displacement body is a cylindrical conduit; and in which flow-guide fins are disposed between said inner wall of said displacement body and said cylindrical conduit to impart a helical flow to said feed water about said conduit.

5. A gas/liquid heat exchanger according to claim 1, in which said means for introducing said feed water into a zone of downwardly flowing water is a downwardly directed down pipe that receives feed water that has been conveyed through said displacement body.

6. A gas/liquid heat exchanger according to claim 1, in which said means for conveying said feed water through said displacement body is a line that extends through the latter; and in which said means for conveying process gas through said displacement body is said displacement body itself.

7. A gas/liquid heat exchanger according to claim 6, in which said line that extends through said displacement body is straight cylindrical and/or enlarged and/or helical.

8. A method of providing heat exchange utilizing a gas/liquid heat exchanger having an upright pressure tank that includes a water chamber, at least one heat-transfer-surface unit, which is disposed in said water chamber and extends along said pressure tank, a saturated steam chamber disposed above said water chamber, and built-in components that divide said water chamber into zones of: water that flows upwardly along said heat-transfer-surface unit, water that flows downwardly, and calm water, with each heat-transfer-surface unit including a displacement body and heat-transfer-surface elements, especially helical heat-transfer-surface elements, that are disposed about said displacement body and have hot process gas under pressure flowing through them, said method including the steps of:

conveying process gas from said heat-transfer-surface elements through said displacement body;

introducing feed water into a bottom end region of said displacement body;

conveying said feed water through said displacement body in countercurrent heat-exchange flow relative to said process gas that is conveyed through said displacement body;

withdrawing said feed water from an upper end region of said displacement body; and introducing said withdrawn feed water into a zone of downwardly flowing water.

9. A method according to claim 8, which includes the step of filling said displacement body with feed water, and conveying said process gas in a line that extends through said displacement body.

10. A method according to claim 9, which includes the step of imparting to said feed water a helical flow about said line by disposing flow-guide fins between said line and an inner wall of said displacement body.

11. A method according to claim 8, which includes the step of conveying feed water from said displacement body to a down pipe that introduces said feed water into said zone of downwardly flowing water.

12. A method according to claim 8, which includes the steps of filling said displacement body with process gas, and conveying said feed water in a line that extends through said displacement body.

* * * * *